US009598854B2

(12) United States Patent
Ter-Borch

(10) Patent No.: US 9,598,854 B2
(45) Date of Patent: Mar. 21, 2017

(54) CORNER BRACKET, A BRACKET SYSTEM, USE OF SUCH A CORNER BRACKET, A WINDOW MOUNTING COLLAR AND A WINDOW MOUNTING SYSTEM

(71) Applicant: Rockwool International A/S, Hedehusene (DK)

(72) Inventor: Hans Henrick Ter-Borch, Holbæk (DK)

(73) Assignee: ROCKWOOL INTERNATIONAL A/S, Hedehusene (DK)

( * ) Notice: Subject to any disclaimer, the term of this patent is extended or adjusted under 35 U.S.C. 154(b) by 0 days.

(21) Appl. No.: 14/902,920

(22) PCT Filed: Jul. 4, 2014

(86) PCT No.: PCT/DK2014/050202

§ 371 (c)(1),
(2) Date: Jan. 5, 2016

(87) PCT Pub. No.: WO2015/000490

PCT Pub. Date: Jan. 8, 2015

(65) Prior Publication Data

US 2016/0153185 A1 Jun. 2, 2016

(30) Foreign Application Priority Data

Jul. 5, 2013 (EP) ..... 13175272

(51) Int. Cl.
*E06B 1/04* (2006.01)
*E04B 1/41* (2006.01)
(Continued)

(52) U.S. Cl.
CPC ..... *E04B 1/40* (2013.01); *E06B 1/02* (2013.01); *E06B 1/342* (2013.01); *E06B 1/6015* (2013.01);
(Continued)

(58) Field of Classification Search
CPC ..... E04B 1/40; E04B 2001/405; E06B 1/02
(Continued)

(56) References Cited

U.S. PATENT DOCUMENTS 5,199,234 A * 4/1993 Guhl ..... E04D 13/0315 52/200
D432,671 S * 10/2000 Grosfillex ..... D25/119
(Continued)

FOREIGN PATENT DOCUMENTS

DE 2090905365 U1 10/1999
DE 202006004425 U1 7/2006
(Continued)

*Primary Examiner* — Basil Katcheves
(74) *Attorney, Agent, or Firm* — Knobbe Martens Olson & Bear LLP

(57) ABSTRACT

A corner bracket for assembly of two boards of a window mounting collar into a collar corner and for affixing said window mounting collar to an exterior face of a building façade so as to surround a window opening, said corner bracket; comprising two holding plates and two base arms, all four adapted for extending in planes parallel with and having back surfaces abutting the exterior face of the building façade in an affixed position of the collar. The bracket further comprises two flanges and two abutment plates adapted to extend away from said exterior face in an affixed position of the collar. Each abutment plate is positioned at a mutual distance from and in parallel with an associated said flange, each abutment plate being connected to the associated said flange via an associated said holding plate; so as to be able to hold said boards together to form said window collar corner, each board being received between a respective flange and its associated abutment plate.

18 Claims, 10 Drawing Sheets

(51) Int. Cl.

| | |
|---|---|
| ***E06B 1/02*** | (2006.01) |
| ***E06B 1/34*** | (2006.01) |
| ***E06B 1/60*** | (2006.01) |
| *E04B 1/38* | (2006.01) |

(52) U.S. Cl.
CPC ..... *E06B 1/6046* (2013.01); *E04B 2001/405* (2013.01); *E06B 1/6069* (2013.01)

(58) Field of Classification Search
USPC ..... 52/204.1, 287.1, 288.1
See application file for complete search history.

(56) References Cited

U.S. PATENT DOCUMENTS

| | | | | |
|---|---|---|---|---|
| 6,341,458 | B1 * | 1/2002 | Burt | E04F 13/0864 52/287.1 |
| 6,553,732 | B2 * | 4/2003 | Shaw | E04F 19/022 52/287.1 |
| 7,453,047 | B2 * | 11/2008 | Muehlebach | H02G 3/0431 174/135 |
| 7,487,623 | B2 * | 2/2009 | Rodolofo | E04D 13/152 52/288.1 |
| D594,563 | S * | 6/2009 | Polston | D25/136 |
| D630,340 | S * | 1/2011 | Southwell | D25/122 |
| D660,459 | S * | 5/2012 | Yoder | D25/102 |
| D700,360 | S * | 2/2014 | Elizarraras | D25/136 |
| 2002/0116890 | A1 | 8/2002 | Moore, Jr. | |
| 2008/0083514 | A1 * | 4/2008 | Munson | A47F 5/0846 160/184 |
| 2010/0139186 | A1 * | 6/2010 | Laremore | E04D 13/0315 52/200 |

FOREIGN PATENT DOCUMENTS

| | | | |
|---|---|---|---|
| DE | 202008016538 | U1 | 4/2009 |
| EP | 1061199 | A1 | 12/2000 |
| GB | 1396881 | A | 6/1975 |
| GB | 2397829 | A | 8/2004 |
| WO | 99/35355 | A1 | 7/1999 |

* cited by examiner

CORNER BRACKET, A BRACKET SYSTEM, USE OF SUCH A CORNER BRACKET, A WINDOW MOUNTING COLLAR AND A WINDOW MOUNTING SYSTEM

CROSS-REFERENCE TO RELATED APPLICATIONS

This application is the U.S. National Phase under 35. U.S.C. §371 of International Application PCT/DK2014/050202, filed Jul. 4, 2014, which claims priority to European Application No. 13175272.7, filed Jul. 5, 2013. The disclosures of the above-described applications are hereby incorporated by reference in their entirety.

FIELD OF THE INVENTION

This invention relates in a first aspect to a corner bracket for assembly of two boards of a window mounting collar into a collar corner and for affixing said window mounting collar to an exterior face of a building façade so as to surround a window opening. The invention also relates in a second aspect to a bracket set comprising a corner bracket, in a third aspect to use of a corner bracket, in a third aspect to a window mounting collar, and in a fourth aspect to a window mounting system.

BACKGROUND OF THE INVENTION

When building façades are insulated with external wall insulation, the window frames of the building can act as a thermal bridge, because the window frames are generally not covered by the external wall insulation. Heat can, therefore, escape from the building by passing from the building interior through the building wall, into the window frame and to the exterior of the building. Such thermal bridges can undermine the benefit of the new insulation.

In order to reduce the thermal bridging effect of the window frames, the windows are often replaced when the external wall insulation is installed. The new windows are often shifted outwards and arranged so that they are in line with the new façade front. This reduces thermal bridging by preventing contact between the window frame and the building wall itself.

However, in order to fix the new windows in place securely, in particular so that the building meets fire regulations, it is often necessary to fix the window in its new position with brackets, which are attached to the window frame at one end and the reveal or window opening in the building wall at the other. In order to provide sufficient support for the window frame, these brackets must be very strong. They are, therefore, generally metal brackets which form a thermal bridge between the window frame and the building wall. Furthermore, since the brackets are attached to the reveal of the building wall, it is necessary to remove the existing window frame before installing the new window frame. This is undesirable, because it leaves the building open to the elements for a period of time. That is particularly problematic when the building remains occupied during the installation process, as is often the case.

DE 20 2008 016 538 U1 discloses an assembly for installation into an opening in a building wall, which includes a facing frame, made from thermally insulating material, which is secured to a frame arranged in the opening of the building wall. The window frame is mounted within the insulating frame.

The insulating frame is attached to the frame arranged in the opening of the building wall. There is also no separation between the plane of the face of the building façade and the window frame. These features make installation of a new window impossible before the existing window is removed.

DE 20 2006 000 4425 describes a frame assembly for sealing a building opening such as a window or door, which comprises a prefabricated insulation system that is integrally joined to a window frame. Brackets are used to fix the window frame itself to the building wall. In this system, the window frame is attached directly to the building wall. Therefore, although installation is quick, a thermal bridge is formed. This system also appears to prevent installation of a new window before the existing window has been removed.

DE 299 05 365 U1 describes a prefabricated thermal insulating element to be placed in the opening in a façade-insulating layer that is aligned with an opening in the building wall. The prefabricated element has a reveal element formed from a thermal insulating material that is attached to a window frame. When the prefabricated element is installed, the window frame sits within the opening of the building wall. This positioning of the window frame makes it impossible to install the prefabricated element before any existing window has been removed.

On the above background the present invention relates in a first aspect to a corner bracket for assembly of two boards of a window mounting collar into a collar corner and for affixing said window mounting collar to an exterior face of a building façade so as to surround a window opening.

Assembly and mounting of the above described window mounting collar on an exterior face of a building façade presents a number of challenges. First, it is desirable to be able to attach the boards to each other to form the collar, either before or during affixing of the collar to the exterior face of the building façade. Further, affixation should be sufficiently strong, and affixing of the boards to each other should preferably be independent from the specific material of the boards, for example from whether it is possible to attach screws to the boards. For example man-made vitreous fibre boards, e.g. mineral wool fibre boards, will not always be able to provide satisfactory affixation of e.g. screws screwed into the boards. Moreover, freedom regarding spacial dimensions of the boards is of value to make in situ adjustment of the dimensions possible. Finally, insulation abilities of the resultant construction are of importance.

SUMMARY OF THE INVENTION

In view of the above the object of the present invention is providing a solution for cheap and effective assembly of a window mounting collar and mounting of this on an exterior face of a building façade.

With the first aspect of the invention this object is met by providing a corner bracket comprising:

two holding plates and two base arms, all four adapted for extending in planes parallel with and having back surfaces abutting the exterior face of the building façade in an affixed position of the collar, the two base arms each being adapted for receiving a fixation member for insertion therethrough and into the building façade such as to fixate the collar to the façade;

a flange arm comprising two flanges adapted to extend away from said exterior face in the affixed position of the collar, each flange having a proximal end configured to be proximal and a distal end configured to be distal to the exterior face in the affixed position of the collar, each flange further having an attaching edge extending from the proximal end to the distal end, the attaching edges of the flanges being attached to each other along at least a part of the attaching edges, the flanges extending at a mutual angle such as to form a flange corner at said attaching edges, the flange corner being adapted to be positioned in an inner corner formed between the two boards in the affixed position of the collar;

two abutment plates adapted to extend away from said exterior face in the affixed position of the collar, each abutment plate having a proximal end configured to be proximal and a distal end configured to be distal to the exterior face in the affixed position of the collar, each abutment plate being adapted to abut a respective outer surface of the two boards in the affixed position of the collar; and each abutment plate being positioned at a mutual distance from and in parallel with an associated said flange, each abutment plate being connected to the associated said flange via an associated said holding plate;

so as to be able to hold said boards together to form said window collar corner, each board being received between a respective flange and its associated abutment plate.

Thus, according to the first aspect of the invention two boards of a window mounting collar may be brought together and preliminarily retained in a collar corner of the collar between the respective associated abutment plates and flanges of the corner bracket. This reduces work time and provides for easier and quicker assembly of the boards. In this context it is possible to provide pretension in the corner bracket material at one or more of the distal ends of the abutment plates and flanges, forcing the abutment plate and associated flange towards each other for better preliminary attachment. Such pretension can in principle be strong enough to provide permanent retention of the boards.

After preliminarily retaining the boards between the plates and the associated flanges, the boards may then be permanently attached to each other by a separate attachment means such as a screw or bolt inserted through the respective associated flanges and plates and through the associated board. Hereby, the attachment means need not be able to firmly grip the material of the boards since the respective associated abutment plates and flanges will be able to retain the boards to the corner bracket by means of pressure exerted on the board by means of for example a bolt head on the one side of the board and an associated nut on the other side.

Mutual attachment of the flanges along the attaching edges provides increased rigidity of the corner bracket in the direction of the flange planes. This is important to ensure that the corner bracket is strong enough to withstand forces not only from gravity of collar, window and/or insulation plates positioned around the collar, but especially also from wind forces acting on the collar after mounting thereof. Also, the attaching edges provide an inner flange corner, which enables or improves guided abutment of the boards against this corner.

Since the corner bracket need not be attached to or be in contact with the boards at or near the outer surface, i.e. the surface of the boards positioned co-planarly with and at a distance from the façade, it is possible to reduce thermal bridging between the façade and the outside.

In an embodiment of the first aspect of the invention said two abutment plates of the corner bracket are positioned at a distance from each other. Preferably, each abutment plate does not extend beyond a plane in which its non-associated flange extends.

In the first aspect of the invention the flanges are directly attached to each other. Thereby, it is not necessary for the abutment plates to be attached to each other for the corner bracket to be held together. The distance between the two abutment plates of the corner bracket enables the corner bracket to be manufactured as one integral piece by punching it out from a single sheet of plate metal (or like material), thereby avoiding a time-consuming assembly process of several parts to form the corner bracket. Accordingly, in a preferred embodiment the corner bracket is obtainable by a process of punching one single work-piece out from a single sheet of plate metal and folding or bending the work-piece into shape. It should be noted that it is alternatively possible to for example cast or mould the bracket in one integral piece to avoid assembly of the bracket. To this end the corner bracket may be manufactured from metal or a plastic material.

In another embodiment said two flanges of the corner bracket extend in respective planes forming a mutual angle of 60-120°, preferably 80-100°, more preferred approximately 90°, and/or said two abutment plates extend in respective planes forming a mutual angle of 60-120°, preferably 80-100°, more preferred approximately 90°, and/or each associated abutment plate and flange extend in parallel planes. Furthermore, each associated holding plate and flange extend in respective planes forming a mutual angle between approximately 60-120°, preferably 80-100°, more preferred approximately 90°, and/or each associated holding plate and abutment plate extend in respective planes forming a mutual angle between approximately 60-120°, preferably 80-100°, more preferred approximately 90°. By providing the corner bracket with angle dimensions close to right angles, an approximately rectangular window mounting collar may be provided that may be attached to the exterior face of a plane building façade, surrounding a window, such that a regular rectangular window frame can be positioned inside said collar. However, the corner bracket may be configured to match windows, collars or facades of other shapes and sizes, such as triangular windows and collars, where the angles may be 60° or less, or pentagonal windows and collars, where the angles may be larger than 90°.

In another embodiment each of said base arms are formed as an extension of the associated said holding plate, each base arm extending away from a plane of the associated said abutment plate so that the associated fixation member can be inserted through the base arm when the two boards are positioned to be held between the respective flanges and abutment plates, and/or at least one of said base arms comprises a receiving aperture for receiving the fixation member therethrough. By providing the corner bracket with base arms as described above it is possible to affix the corner bracket to the exterior face of the building façade, both with or without the two boards positioned between the respective flanges and abutment plates, thus facilitating the possibility of providing collars already assembled with corner brackets mounted to the boards at each corner of the collar, ready for affixing on the exterior face at delivery. Furthermore, the corner bracket may be attached to the exterior face of the building facade to achieve the advantages therewith as explained above.

Each base arm and each associated abutment plate or associated flange may extend in respective planes forming a mutual angle between approximately 60-120°, preferably 80-100°, more preferred approximately 90°. With angle dimensions as described above, an approximately plane back surface of the corner bracket is provided, which may be adapted to abut a plane of the exterior face, such as to create greater stability and strength.

In another embodiment each of said base arms is obtainable by punching it out from an associated one of said abutment plates and folding or bending it into position. This makes it possible to manufacture the base arms integral with the associated abutment plates, thereby avoiding time-consuming assembly of several parts.

In another embodiment at least one of each associated abutment plate and flange comprises at least one retention aperture positioned for receiving a preferably oblong retention member, such as a screw or a bolt, inserted through the associated abutment plate, through the board to be positioned between the associated abutment plate and flange, and through the associated flange so as to press the board in between the associated abutment plate and flange to retain the board, the abutment plate and flange being pulled against each other by means of the retention member. The screw or bolt may at one end comprise a head with a nut or the like screwed upon the opposite end of the screw or bolt such as to provide oppositely directed forces by the head and the nut, respectively, on each side of the board to be retained between the respective flange and associated abutment plate. The at least one retention aperture may be one or more slots or holes, preferably with several apertures positioned to make it easier to match retention member with retention aperture at an end of the retention member first inserted into the retention aperture, i.e. when the retention member comes out of the board on the opposite side of the board. By pressing the board in between the associated abutment plate and flange to retain the board by means of the retention member the respective associated abutment plates and flanges will be able to retain each of the two boards to the corner bracket independent of whether or not the specific material of the boards allows for firm attachment of the retention member, such as a screw, to the board itself. This allows for use of for example boards manufactured from man-made vitreous fibre, e.g. mineral wool fibre, with the associated advantages thereof.

However, if the boards are formed from material in which it is possible to sufficiently firmly attach screws or like retention members, it may also be possible to affix the boards to the bracket corner by inserting the retention member such that it does not extend fully through the board, thereby not connecting the associated abutment plate and flange.

In an embodiment of the first aspect of the invention the corner bracket further comprises two boards of a window mounting collar assembled to form a collar corner by means of the corner bracket, said two boards being held together by the corner bracket to form said collar corner, each board being received between a respective flange and its associated abutment plate, wherein each board has an outer board surface, which is adapted to be parallel with and to face away from the exterior face of the façade in the affixed position of the collar, each flange and associated abutment plate being in contact with an associated one of said two boards, the distal end of each flange and/or of each abutment plate being positioned at a distance from the outer board surface of its associated board of 10% to 150%, preferably 25% to 75%, more preferred approximately 50%, of a length of the respective flange or abutment plate. This distance between the distal end of the flanges and abutment plates from the outer board surface minimizes the corner bracket's thermal bridging between the surroundings and the exterior face of the façade.

In the second aspect of the present invention the above object is met by providing a bracket set, which comprises a corner bracket according to the first aspect of the invention as well as one or two further, different brackets. By providing different bracket types, where each bracket is formed from the same base bracket shape, a more cost-effective and simple production is facilitated. Each bracket may for example be punched out in the same pattern from a sheet of plate metal after which further punching or different folding procedure may result in the different brackets. Each bracket of the bracket set may thus be produced in very much the same process, thereby to a large extent avoiding different process steps.

Furthermore, by providing the bracket set, it is possible to not only assemble the collar by using the corner brackets, but also to provide additional support and rigidity along the boards. The joining bracket also provides for the possibility of assembling two boards at their respective ends along a side of the mounting collar, thereby making it possible to use more of the board material when the boards are provided in standard lengths. This material would otherwise need to be disposed of.

In the third aspect of the invention the above object is met by providing use of a corner bracket according to the first aspect of the invention for holding together two boards of a window mounting collar to form a window mounting collar corner, each board being received between a respective flange and its associated abutment plate and attached by means of a preferably oblong retention member inserted through the respective flange, the respective board and the abutment plate associated with said respective flange, and further for affixing said window mounting collar to an exterior face of a building façade so as to surround a window opening, the two base arms each receiving a preferably oblong fixation member for insertion therethrough and into the building façade such as to fixate the window mounting collar to the façade.

Such use simplifies both collar assembly and mounting process as the collar assembly can be combined with the process of affixing the boards of the collar to the corner bracket. This can be done both prior to, during or after the corner bracket is affixed to the exterior face of the building façade.

In the fourth aspect of the invention the above object is met by providing a window mounting collar having at least one inside face, at least one outside face, a first open end and a second open end and comprising a corner bracket according to the first aspect of the invention.

This window mounting collar may be affixed to the exterior face to surround a window and may be adapted to receive the window through the first or second open end, the window further being received by the at least one inside face of the collar.

The window mounting collar may be made using boards of any suitable material, such as plywood, cement or similar common building materials. However according to an embodiment at least one of the boards comprises or is manufactured from man-made vitreous fibre material. Such boards have a number of advantages in this context, such as resistance to deterioration from rot, fungus etc, superior fire rating, superior thermal conductivity, and relatively low weight.

In the fifth aspect of the present invention the above object is met by providing a window mounting system comprising a building façade having an interior face and an exterior face and comprising a window opening and a window mounting collar according to the fourth aspect of the invention, the window mounting collar preferably comprising two side boards, an upper cross board and a lower cross board, each having an inside face and an outside face, wherein at least one and preferably each side board is joined orthogonally to the upper and lower cross boards by means of a corner bracket according to the first aspect of the invention.

Since the collar is affixed directly to the exterior face opposed to the inside of the window opening, the process of moving the window from an original position to a position in the collar, may be performed without first having to remove the window to attach the collar, thereby providing for a quicker and easier assembly, see also the remarks described above in the disclosure of the background of the present invention.

BRIEF DESCRIPTION OF THE DRAWINGS

The invention is described further below with reference to the Figures, where FIGS. 1 to 4*b* are not according to the invention.

FIG. 1 shows a first window mounting collar.

FIG. 2 shows a first window mounting system.

FIG. 3 shows a section through the system of FIG. 1, viewed from above.

FIGS. 4*a* and 4*b* show a bracket system from two angles.

DETAILED DESCRIPTION OF THE PREFERRED EMBODIMENTS

Figure 1:
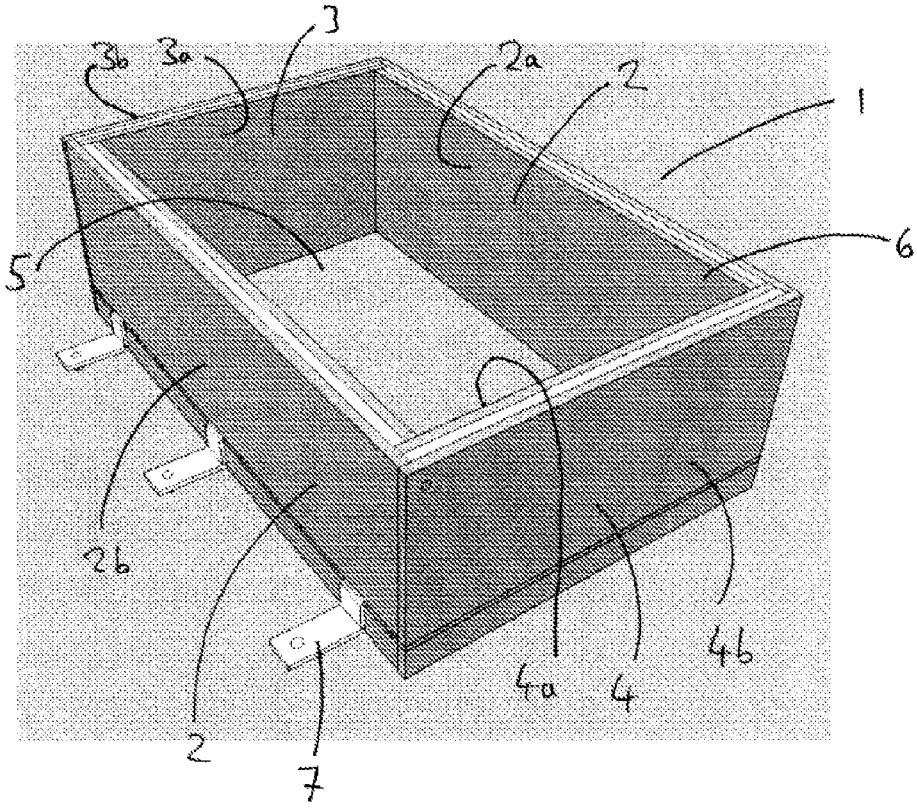

In FIG. 1, a window mounting collar 1 is shown before installation on a building façade. The mounting collar 1 comprises two side boards 2, an upper cross board 3 and a lower cross board 4, each having an inside face 2*a*, 3*a*, 4*a* and an outside face 2*b*, 3*b*, 4*b*, wherein each side board 2 is joined orthogonally to the upper and lower cross boards 3, 4. The mounting collar has a first open end 5, which, when installed, faces the exterior face of the building façade. The second open end 6 of the mounting collar 1 receives a window frame, which can be installed either before the mounting collar is affixed to the building façade or after the mounting collar has been affixed to the building façade.

In the embodiment shown, the two side boards 2, the upper cross board 3 and the lower cross board 4 are each formed from three layers of man-made vitreous fibre boards, each layer comprising man-made vitreous fibres and binder.

Preferably, each board has a bending strength of at least 7 N/m2 and a point load resistance of at least 500 kN.

The board preferably has a thermal conductivity, measured in a direction from the first end to the second of the collar, of below 0.150 W/m·K, preferably below 0.100 W/m·K. The thermal conductivity of the board, measured in a direction from its inside face to its outside face, is preferably below 0.150 W/m·K, more preferably below 0.100 W/m·K. The thermal conductivity of the board, measured in a direction from its inside face to its outside face, is often lower than the thermal conductivity, measured in a direction from the first end to the second of the collar. Most preferably, the thermal conductivity of the board, measured in a direction from its inside face to its outside face, is below 0.075 W/m·K.

In one embodiment, the board comprises man-made vitreous fibres and binder and has a density of at least 150 kg/m3. Such compressed man-made vitreous fibre boards generally have sufficient rigidity and strength to support window frames without the use of additional brackets attaching the window frame to the building façade directly. It is preferred that the material has a density of at least 200 or at least 300 kg/m3. Usually, the density is less than 600 kg/m3, preferably less than 500 kg/m3.

Particularly suitable man-made vitreous fibre boards are produced according to the method described in WO2011/012712. Preferably, the boards comprise from 1% to 20% binder and from 80 to 99% man-made vitreous fibres.

Compressed man-made vitreous fibre boards have the additional benefit that they are fire-proof. In a preferred embodiment, the man-made vitreous fibre boards are layered to form the sides of the mounting collar. Where at least two man-made vitreous fibre boards are layered at their large surfaces, the bending strength of the mounting frame can be improved, thereby improving the stability of the system.

Alternatively, the mounting collar can be formed from polymeric foam, for example polyurethane foam.

In a further embodiment, the mounting collar is formed from a polymeric foam composite material comprising a polymeric foam and man-made vitreous fibres, wherein at least 50% by weight of the man-made vitreous fibres present in the polymeric foam composite material have a length less than 100 micrometers. Such a polymeric foam composite is discussed in our co-pending application PCT/EP2012/066196.

Attached to the mounting collar 1, on its outside faces 2*b*, 3*b*, 4*b*, are brackets 7. In the embodiment shown, the brackets 7 are L-shaped brackets, which are positioned on the outside faces of the mounting collar adjacent to its first open end 5.

Figure 2:
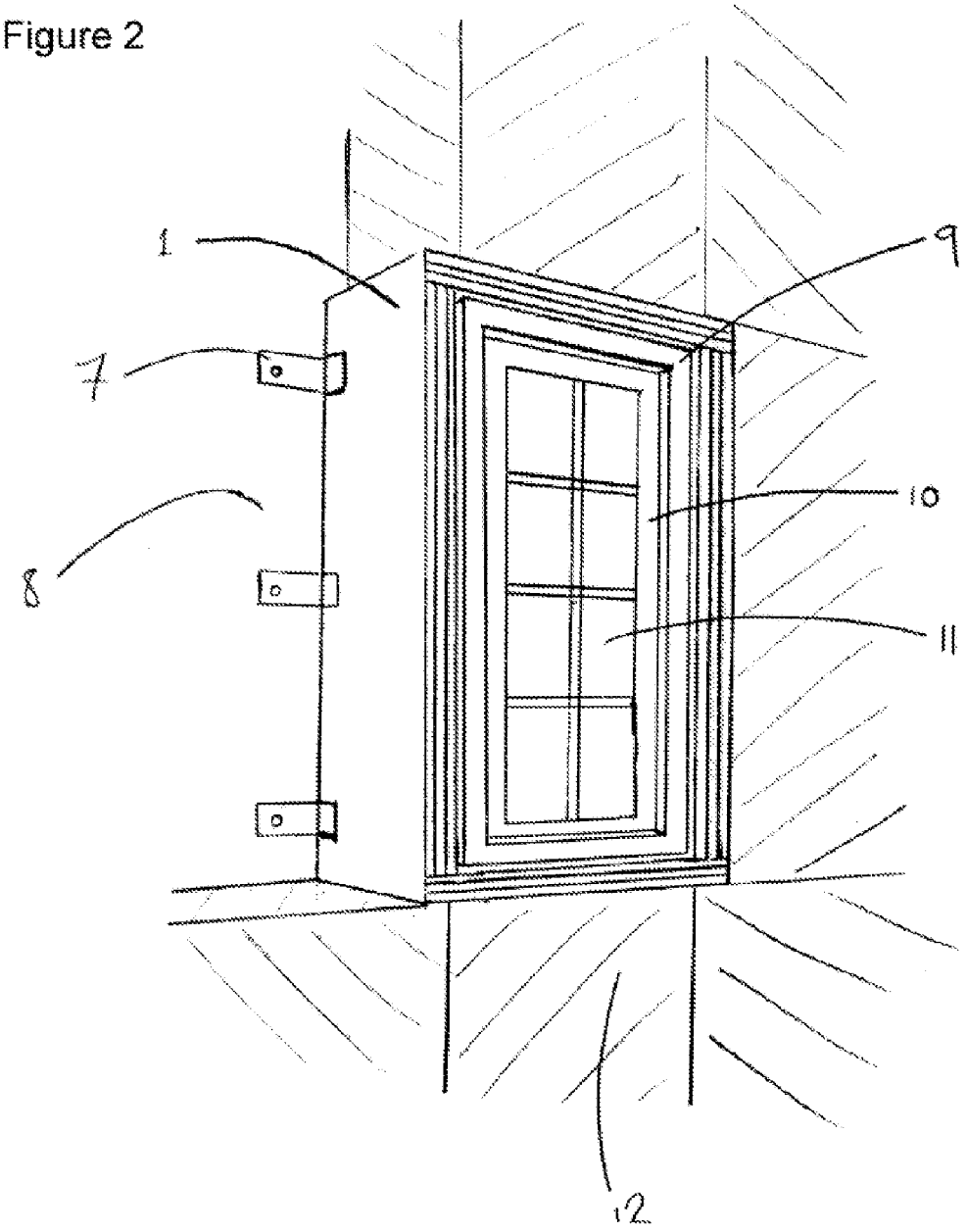

FIG. 2 shows the mounting collar 1 in place on a building façade 8, as part of a complete window mounting system. Brackets 7 affix the mounting collar 1 to the exterior face of the building façade 8. A window frame 9 is mounted in the mounting collar such that there is a separation d shown in FIG. 3 of at least 10 mm between the window frame 9 and the plane of the exterior face of the building façade 8. The window frame 9 surrounds a window sash 10 and window panes 11. External wall insulation 12 not shown on one side of the mounting collar is positioned around the outside of the mounting collar 1 and affixed to the building façade 8. The external wall insulation 12 has the same depth as the mounting collar 1, so the window frame 9 is arranged to be flush with the outer surface of the external wall insulation 12.

Figure 3:
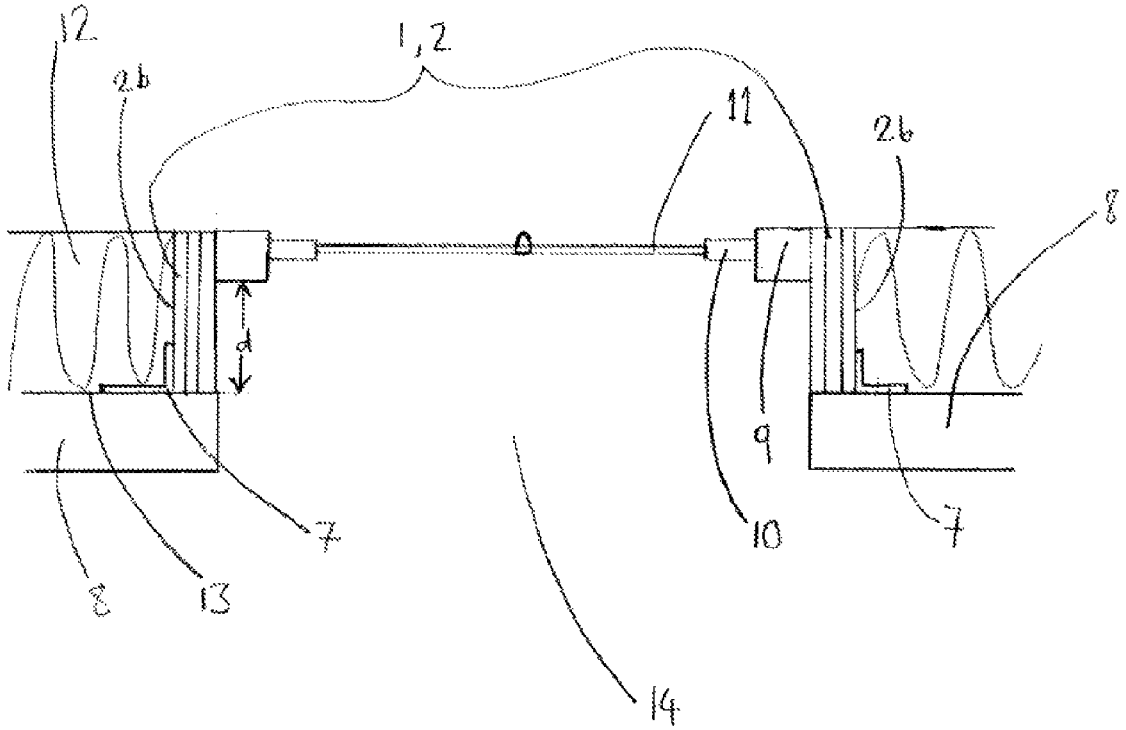

FIG. 3 shows a section through the system of FIG. 2, viewed from above. The side boards 2 of the mounting collar 1 are affixed to the exterior face 13 of the building façade 8. The side boards 2 extend perpendicularly outwards from the building façade 8. L-shaped brackets 7 have two perpendicular arms, one of which is attached to an outside face 2*b* of the mounting collar 1, the other of which is attached to the exterior face 13 of the building façade 8. The separation d between the window frame 9 and the plane of the exterior face 13 of the façade allows the mounting collar 1 to be fitted when an existing window is still present in the window opening 14. External wall insulation 12 is present on either side of the mounting frame 1. The mounting collar 1 extends away from the building façade 8 by the same distance as the depth of the external wall insulation 12. Means for attaching the window frame 9 to the mounting collar 1 are not shown, but could, for example, be screws passing through the window frame 9 and into the mounting collar 1.

Figure 4A:
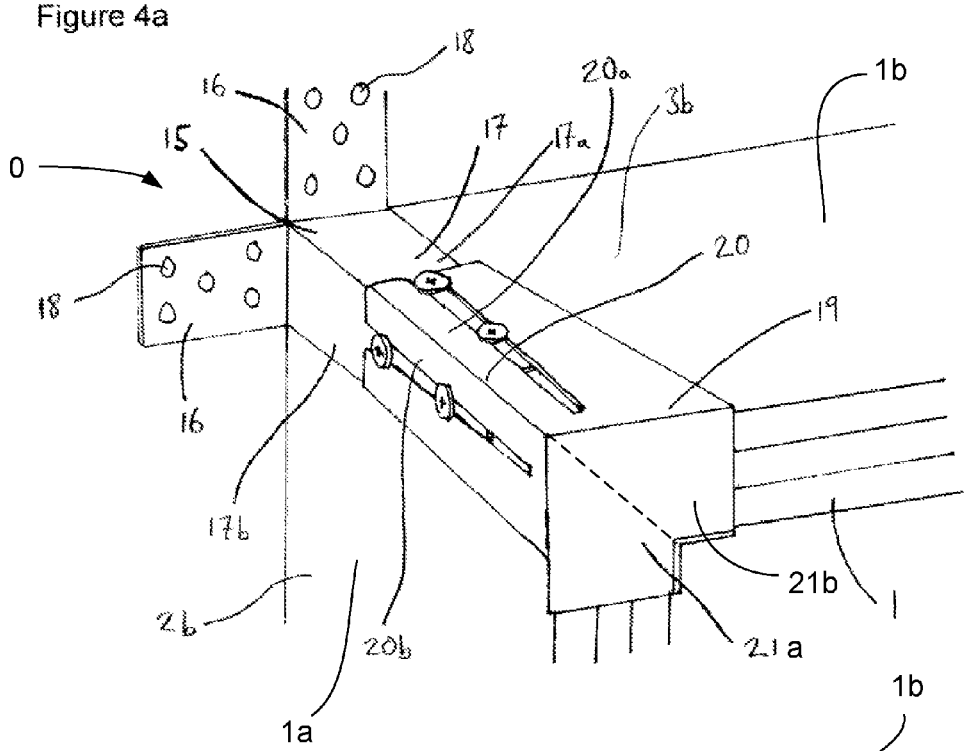
Figure 4B:
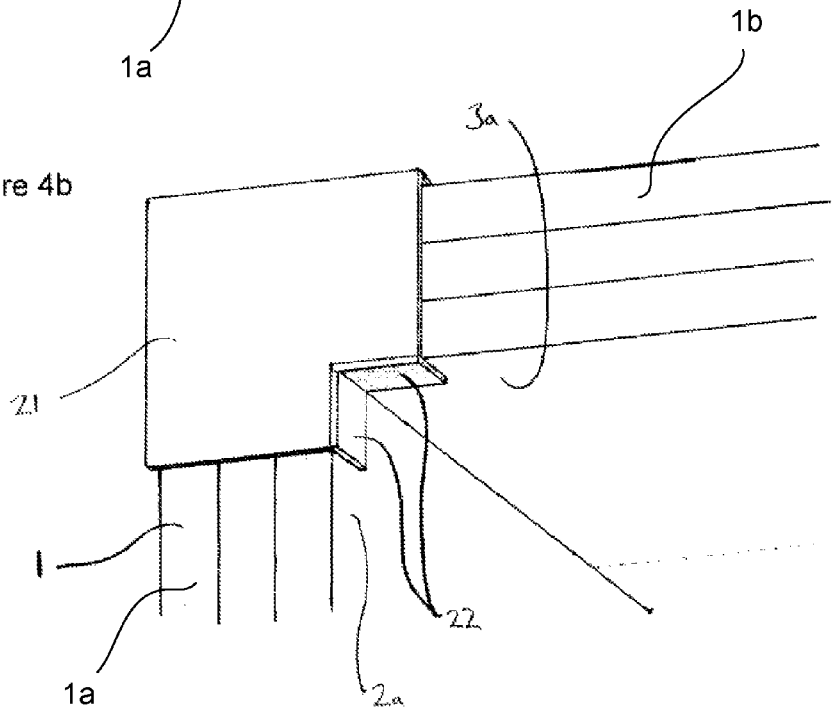

FIGS. 4*a* and 4*b* show a corner system that may be used with the window mounting collar 1 according to FIG. 1 and comprising two boards 1*a* and 1*b* of the window mounting collar 1 assembled to form a collar corner by means of a corner bracket denoted 0. The window mounting collar could be in the form of that shown in FIG. 1. The corner bracket 0 comprises a bracket part 15 with two base arms 16 in the form of plates and flange arm 17, which comprises two abutment plates 17*a*, 17*b* that are substantially perpendicular to each other and are joined at one edge. The two abutment plates 17*a*, 17*b* extend away from the exterior face of the facade 8 in the affixed position of the collar 1. Each abutment plate 17*a*, 17*b* has an end proximal and an end distal to the exterior face of the facade 8 in the affixed position of the collar 1. Each abutment plate 17*a*, 17*b* abuts a respective outer surface of the two boards 1*a*, 1*b*. In the embodiment of FIGS. 4*a* and 4*b* the two abutment plates 17*a*, 17*b* are attached to each other along a mutual attachment edge.

The two base arms 16 extend in planes parallel with the exterior face of the building façade in the affixed position of the collar 1. The two base arms 16 further have back surfaces for abutting the exterior face and are each provided with five fixation member holes or receiving apertures 18 for receiving fixation members (not shown), such as screws, therethrough and into the building façade such as to fixate the collar 1 to the façade. The second arm 17 of the bracket part 15 extends away from the exterior face of the building façade 8 along two of the outside faces 2*b*, 3*b* of the boards 1*a*, 1*b*, respectively, of the mounting collar 1.

Holding part 19 has an attachment arm 20 and two holding plates 21*a*, 21*b* formed as two connected parts of one single plate positioned at an outer surface of the two boards 1*a*, 1*b*. The holding plates 21*a*, 21*b* extend in planes parallel with and are positioned at a distance from the exterior face of the building façade 8 in the affixed position of the collar 1. The attachment arm 20 is in the form of two substantially orthogonal plates 20*a*, 20*b*, attached to each other at one edge, and each attached to the holding plate 21 at one end. The holding plate 21 is L-shaped to match the shape of the corner of the mounting collar 1 and has two flanges 22 that are perpendicular to each other and perpendicular to the holding plate 21. The flanges 22 extend away from the exterior face of the facade 8 in the affixed position of the collar 1 to be attached to respective edges of the holding plates 21*a*, 21*b* positioned opposite to the edges attached to the plates 20*a*, 20*b* of the attachment arm 20. The flanges 22 lie against two adjoining inside faces 2*a*, 3*a* of the respective boards 1*a*, 1*b* of the mounting collar 1. Each flange 22 has an end proximal to and an end distal to the exterior face of the facade 8 in the affixed position of the collar 1. The flanges 22 extend at a mutual angle of about 90° such as to fit snugly into an inner corner formed between the two boards 1*a*, 1*b*.

Each abutment plate 17*a*, 17*b* is positioned at a mutual distance from and in parallel with an associated of the two flanges 22. This distance is established as corresponding to the thickness of the boards 1*a*, 1*b* since the associated flange 22 and abutment plate 17*a*, 17*b* are positioned on each side of the respective board 1*a*, 1*b*. Each abutment plate 17*a*, 17*b* is connected to the associated of the flanges 22 via an associated of the holding plates 21*b*, 21*a*, respectively. Each abutment plate 17*a*, 17*b* extends in this embodiment beyond a plane in which its non-associated flange 22 extends; for example, the abutment plate 17*a* extends farther in the left direction of FIG. 4*a* than to the plane in which the lowermost flange (which abuts the holding plate 21*a*) extends. The plane, in which the lowermost flange (which abuts the holding plate 21*a*) extends, extends along the inside face 2*a* of board 1*a*. Each associated abutment plate 17*a*, 17*b* and flange 22 extend in parallel planes. Each of the base arms 16 are positioned at a distance from the associated holding plate 17*a*, 17*b*.

Hereby, the two boards 1*a*, 1*b* are held together by the corner bracket 0 to form the window collar corner, each board 1*a*, 1*b* being received between a flange 21*a*, 21*b* and its associated abutment plate 17*b*, 17*a*, respectively.

Since the holding plates 21*a*, 21*b* are attached along outer edges to the plates 20*a*, 20*b*, respectively, the corner bracket is in this embodiment not directly obtainable by a process of punching one single work-piece out from a single sheet of plate metal and folding or bending the work-piece into shape.

In the corner bracket shown in FIGS. 4*a* and 4*b* the two flanges 22 extend in respective planes forming an angle between them of approximately 90°, and the two abutment plates 17*a*, 17*b* extend in respective planes forming a mutual angle of 90°. Each associated holding plate 21*a*, 21*b* and flange 22 extend in respective planes forming an angle of approximately 90°, and each associated holding plate 21*a*, 21*b* and abutment plate 17*b*, 17*a*, respectively, extend in respective planes forming an angle of approximately 90°.

The abutment plates 17*a*, 17*b* each comprises a slit extending along the respective abutment plates 17*a*, 17*b* for receiving screws inserted into the respective boards 1*a*, 1*b*. To this end the boards 1*a*, 1*b* may be manufactured from wood.

Figure 5:
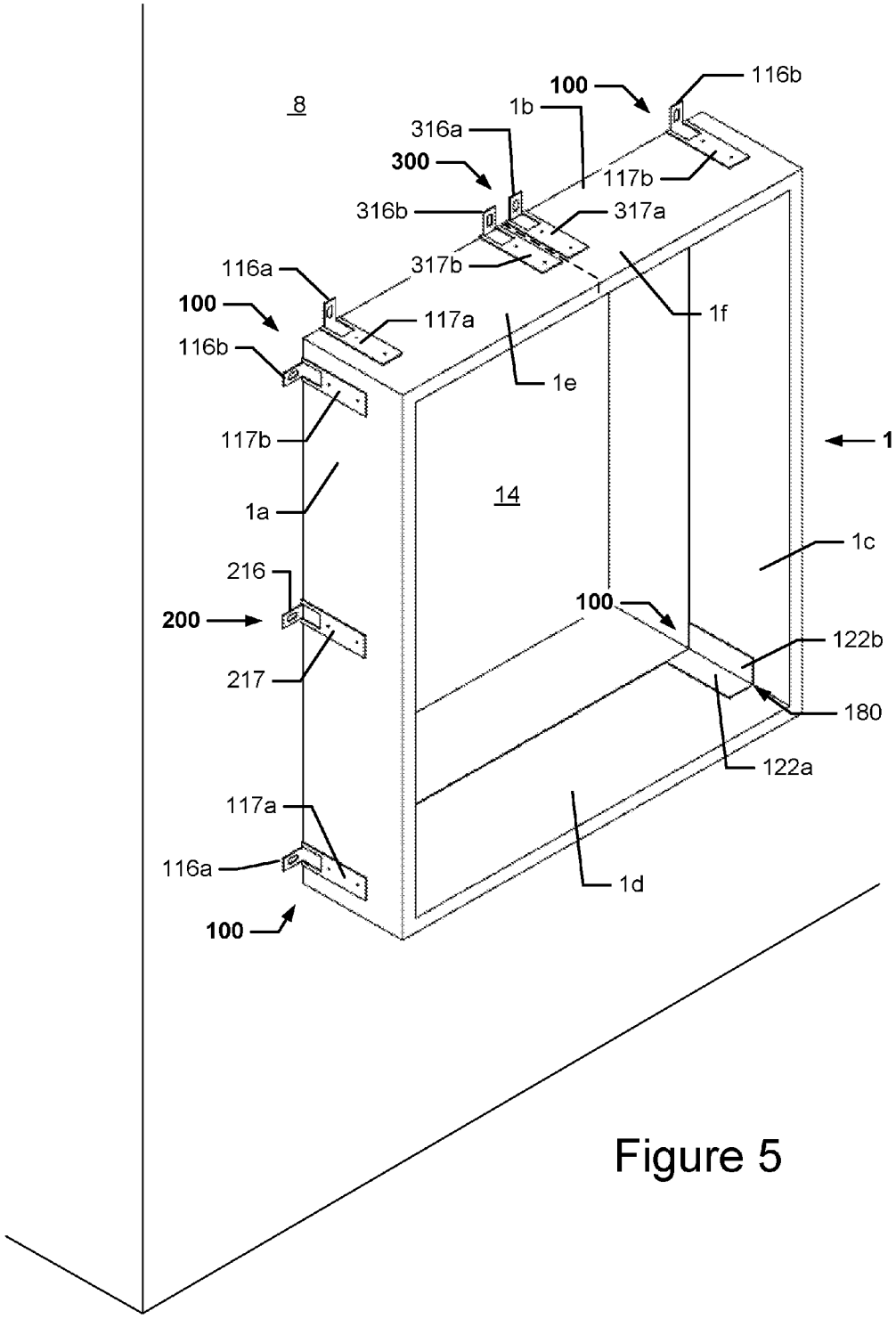
FIG. 5 shows a second window mounting collar, which is according to the fourth aspect of the present invention.

FIG. 5 shows a window mounting collar, for the sake of convenience also denoted 1, according to the fourth aspect of the present invention and mounted in place on an exterior face of a building façade 8, the collar 1 forming part of a complete window mounting system surrounding a window opening 14. Four corner brackets 100, each according to the first aspect of the invention, one holding bracket 200 and one joining bracket 300 affix the mounting collar 1 to the exterior face of the building façade 8.

Features of the corner bracket 100, holding bracket 200 and joining bracket 300, which are similar or like in function to the associated features of the bracket 0 in FIGS. 4*a* and 4*b*, are referred to herein with reference numbers with 100, 200 and 300 added, respectively.

The brackets 100, 200, 300 specifically retain four boards 1*a*, 1*b*, 1*c*, 1*d* of the collar 1 between respective abutment plates 117*a*, 117*b*, 217, 317*a*, 317*b* and associated flanges 122*a*, 122*b*, 222, 322*a*, 322*b*, respectively, of the brackets 100, 200, 300 as shown in FIGS. 6-9. Note that a further, similar joining bracket (not shown) may be positioned oppositely on the board 1*c*, and a further, similar holding bracket or joining bracket may be positioned oppositely on the board 1*d*. Generally, the number of corner brackets, holding brackets and joining brackets may vary depending on window size, number of boards, collar dimensions etc.

In FIG. 5 the base arms 116*a*, 116*b*, 216, 316*a*, 316*b* of the corner brackets 100, holding bracket 200 and joining bracket 300 are visible on an outside of the upper 1*b* and the left 1*a* board of the collar 1. The base arms 116*a*, 116*b*, 216, 316*a*, 316*b* lie parallel with and abut the building façade 8. Similarly the abutment plates 117*a*, 117*b*, 217, 317*a*, 317*b* of the corner brackets 100, holding bracket 200 and joining bracket 300 are visible on an outside of the upper 1*b* and the left 1*a* board of the collar 1. The abutment plates 117*a*, 117*b*, 217, 317*a*, 317*b* lie parallel with and abut an associated board 1*a*, 1*b*, 1*c*, 1*d* of the window mounting collar 1.

In FIG. 5 an inside of a flange arm 180 of a corner bracket 100 is visible at the inside bottom right corner of the collar 1. The flange arm 180 comprises two flanges 122*a*, 122*b*.

Similar to the embodiment of the window mounting system as shown in FIG. 2, external wall insulation (not shown in FIG. 5) may be positioned around the outside of the mounting collar 1 and affixed to the building façade 8. The external wall insulation may have the same depth as the mounting collar 1, e.g. 300 mm, so that a window frame may be arranged to approximately be flush with an outer surface of the external wall insulation.

Figure 6A:
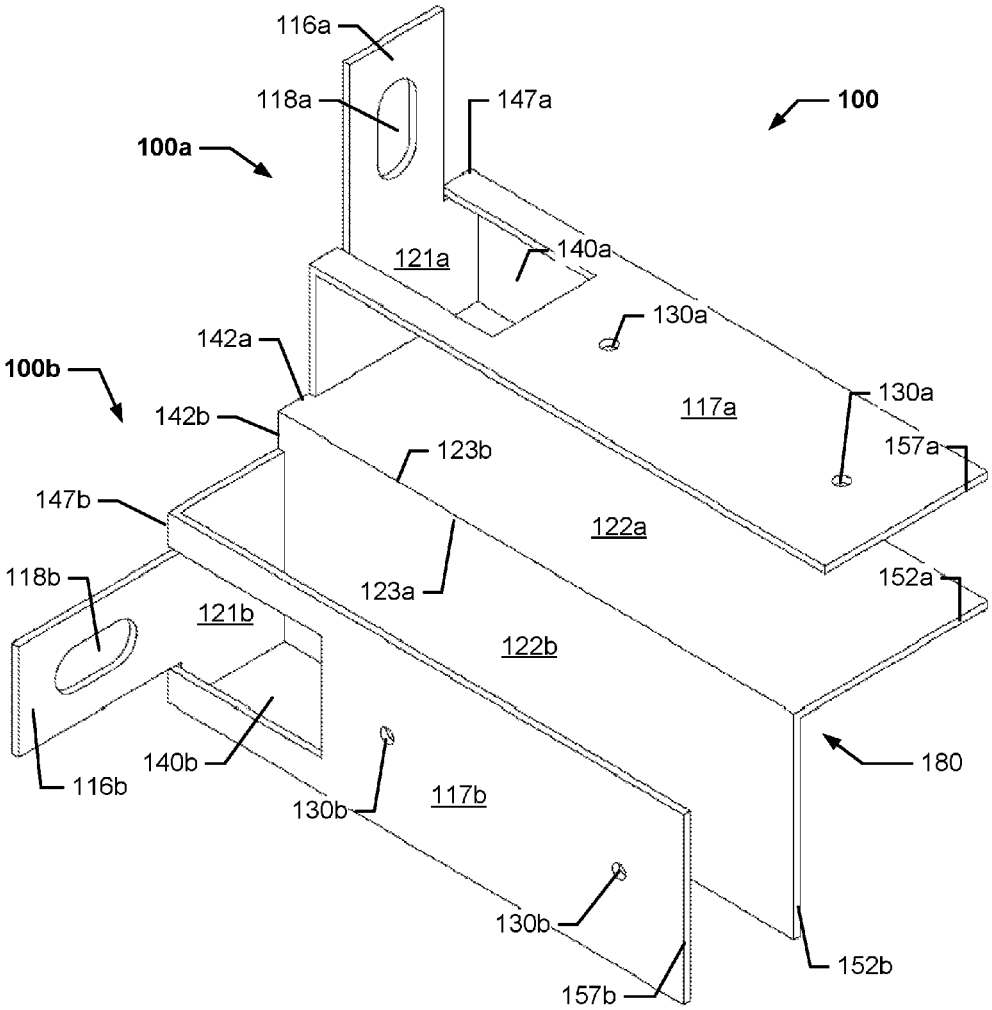
FIG. 6*a* shows a perspective view of an embodiment of the corner bracket according to the first aspect of the invention.
Figure 6B:
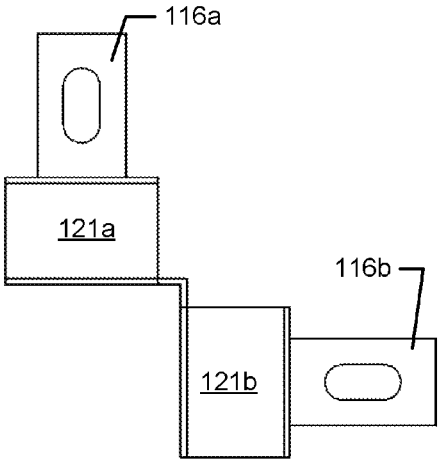
FIG. 6*b* shows a first side view of the corner bracket shown in FIG. 6*a*.
Figure 6C:
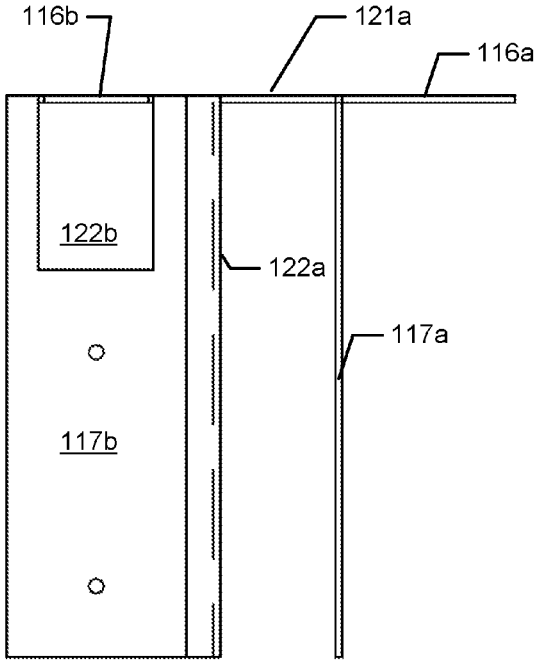
FIG. 6*c* shows a second side view of the corner bracket shown in FIG. 6*a*.

FIGS. 6*a*, 6*b* and 6*c* show one of the corner brackets 100 for assembly of two respective boards 1*a*, 1*b*; 1*b*, 1*c*; 1*c*, 1*d*; 1*d*, 1*a* of the window mounting collar 1 of FIG. 5 into a collar corner and for affixing the window mounting collar 1 to the exterior face of the building façade 8 so as to surround the window opening. The corner bracket 100 is symmetrical so as to be divided into a first bracket part 100*a* and a second bracket part 100*b*, which is formed similar to the first bracket part 100*a*, but symmetrically over a symmetry plane. The bracket part 100*a* comprises one holding plate 121*a*, one associated base arm 116*a*, one associated abutment plate 117*a* and one associated flange 122*a*. The bracket part 100*b* similarly comprises one holding plate 121*b* one associated base arm 116*b*, one associated abutment plate 117*b* and one associated flange 122*b*.

Generally, in the context of the present specification it is noted that the term "associated" when used in relation to the abutment plate, flange, holding plate and base arm of the corner bracket should be understood as "forming part of the same of the two bracket parts". The "associated board" is equivalently the board positioned between a abutment plate and associated flange of a corner bracket.

Each holding plate 121*a*, 121*b* and its associated base arm 116*a*, 116*b*, respectively, extend in planes parallel with and having back surfaces abutting the exterior face of the building facade 8.

The base arms 116*a*, 116*b* are formed as respective extensions of their associated holding plate 121*a*; 121*b*, extending away from a plane of the associated said holding plate 121*a*; 121*b*. Each holding plate 121*a*, 121*b* is at one edge attached to the associated base arm 116*a*, 116*b*. The base arms 116*a*, 116*b* have a width (defined as the direction extending along a longitudinal direction of the associated board) somewhat smaller than the width of the holding plates 121*a*, 121*b*, and extend away from the holding plate 121*a*, 121*b*. The base arms 116*a*, 116*b* further each comprise one elongated, approximately elliptical receiving aperture 118*a*, 118*b* positioned approximately at the centre of the respective base arm 116*a*, 116*b* in the width direction, and extending in the same direction as the respective base arm 116*a*, 116*b*. The receiving apertures 118*a*, 118*b* receives a fixation member in the form of a screw or bolt therethrough and into the building façade 8, such as to fixate the collar 1 to the façade 8 when the board is positioned to be held between the associated flange 122*a*; 122*b* and abutment plate 117*a*; 117*b*.

Each abutment plate 117*a*, 117*b* extends approximately perpendicularly away from its associated holding plate 121*a*, 121*b* and base arm 116*a*, 116*b*. Each abutment plate 117*a*, 117*b* comprise a proximal end 147*a*, 147*b* configured to be proximal and a distal end 157*a*, 157*b* configured to be distal to the exterior face of the façade 8 in the affixed position of the collar 1. Each abutment plate 117*a*, 117*b* is connected at its proximal end 147*a*, 147*b*, respectively, to the associated holding plate 121*a*, 121*b* and associated base arm 116*a*, 116*b* at a line dividing the associated holding plate 121*a*, 121*b* and the associated base arm 116*a*, 116*b*. Each abutment plate 117*a*, 117*b* is adapted to abut a respective outer surface of the associated board 1*a*, 1*b*, 1*c*, 1*d* in the affixed position of the collar 1.

In the embodiment of FIG. 6*a* to 6*c* each abutment plate 117*a*, 117*b* does not extend beyond a plane in which its non-associated flange 122*b*, 122*a*, respectively, extends. The abutment plate 117*a* with which the flange 122*b* is not associated is referred to as the non-associated abutment plate thereof. Similarly, the abutment plate 117*b* with which the flange 122*a* is not associated is denoted the non-associated abutment plate thereof.

Each abutment plate 117*a*, 117*b* further comprises two retention apertures 130*a*, 130*b* positioned for receiving an oblong retention member (not shown) in the form of a screw or a bolt inserted through the associated abutment plate 117*a*, 117*b*, through the board 1*a*, 1*b*, 1*c*, 1*d* to be positioned between the associated abutment plate 117*a*, 117*b* and flange 122*a*, 122*b*, and through the associated flange 122*a*, 122*b*. Hereby, the board may be pressed in between the associated abutment plate 117*a*, 117*b* and flange 122*a*, 122*b* to retain the board, the abutment plate 117*a*, 117*b* and flange 122*a*, 122*b* being pulled against each other by means of the retention member. The abutment plate 117*a*, 117*b* additionally comprises a cut-out 140*a*, 140*b* extending from its proximal end towards its distal end, which provides for the base arm 116*a*, 116*b* to be folded into position, see further below regarding manufacture of the brackets according to the invention.

Each flange 122*a*, 122*b* extends approximately perpendicularly away from its associated holding plate 121*a*, 121*b*, and is positioned at a mutual distance from and in parallel with its associated abutment plate 117*a*, 117*b*. Each flange 122*a*, 122*b* has a proximal end 142*a*, 142*b* configured to be proximal, and a distal end 152*a*, 152*b* configured to be distal to the associated holding plate 121*a*, 121*b*. The flange 122*a*, 122*b* is attached at one edge at its proximal end to an edge of its associated holding plate 121*a*, 121*b*. The flange 122*a*, 122*b* is wider than its associated holding plate 121*a*, 121*b*.

Finally, the bracket parts 100*a*, 100*b* are connected via flange arm 180 comprising the two flanges 122*a* and 122*b*. Each flange 122*a*, 122*b* has an attaching edge 123*a*, 123*b*, respectively, extending from the proximal end 142*a*, 142*b* to the distal end 152*a*, 152*b*. The attaching edges 123*a*, 123*b* are attached to each other along the entire part of the attaching edges 123*a*, 123*b*, but may in other embodiments extend only along part of the edges 123*a*, 123*b*. For example one or more discontinuations could be provided between the ends 142*a*, 152*a*; 152*a*, 152*b*, respectively, the ends being attached to each other, which can save bracket material. The flanges 122*a*, 122*b* extend approximately perpendicularly to each other, forming an inner flange corner supporting the inner faces of the associated two boards, for example 1*a*, 1*b*, in the affixed position of the boards.

The symmetry plane dividing the corner bracket 100 into the two bracket parts 100*a*, 100*b* extends through the attaching edges 123*a*, 123*b* of the flanges 122*a* and 122*b*.

In FIG. 5 associated pairs of the boards 1*a*, 1*b*, 1*c*, 1*d* are received between a respective flange 122*a*, 122*b* and an associated abutment plate 117*a*, 117*b* of each corner bracket 100. Each board 1*a*, 1*b*, 1*c*, 1*d* has an outer board surface, which is parallel with and faces away from the exterior face of the façade 8. Each flange 122*a*, 122*b* and associated abutment plate 117*a*, 117*b* are thus in contact with an associated one of the boards 1*a*, 1*b*, 1*c*, 1*d*, the distal end 152*a*, 152*b*, 157*a*, 157*b* of each flange 122*a*, 122*b* and/or of each abutment plate 117*a*, 117*b* being positioned at a distance from the outer board surface of its associated board 1*a*, 1*b*, 1*c*, 1*d*. The respective distal ends 152*a*, 152*b*, 157*a*, 157*b* of the flanges 122*a*, 122*b* and abutment plates 117*a*, 117*b* are positioned at a distance from the outer board surface of the associated board 1*a*, 1*b*, 1*c*, 1*d* of approximately 200 mm, i.e. about 50% of a length measured in the depth direction of the collar 1 of the respective flange 122*a*, 122*b* or abutment plate 117*a*, 177*b*.

Note that according to the invention the bracket parts 100*a* and 100*b* need not necessarily be similar, and the holding plates 121*a*, 121*b*, base arms 116*a*, 116*b*, abutment plates 117*a*, 117*b* or flanges 122*a*, 122*b* may be of respective different shapes or sizes. For example the length of abutment plates 117*a*, 117*b* and flanges 122*a*, 122*b*, respectively, may be different from each other.

Figure 7:
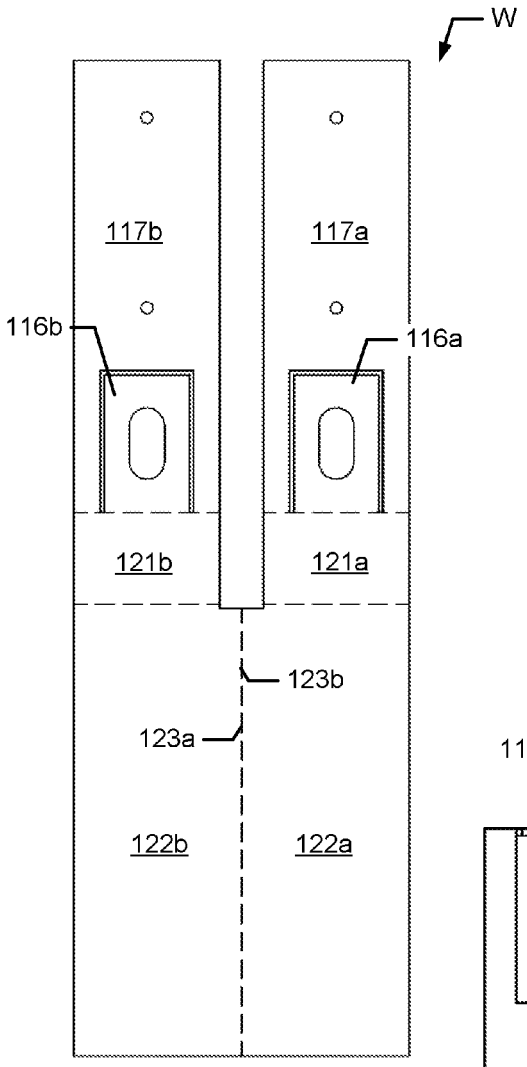
FIG. 7 shows a top view of a work-piece punched out from one single sheet of plate metal, the work-piece being adapted to be folded or bent into the corner bracket of FIG. 6*a*.

FIG. 7 shows a top view of a work-piece W punched out from one single sheet of plate metal. The work-piece W is subsequently folded or bent into the corner bracket 100 of FIG. 6*a*. The folding lines are shown with dashed lines. All foldings are by approximately 90°. Similarly, the holding bracket 200 of FIG. 8 and joining bracket 300 of FIG. 9 are manufactured by punching out from a single sheet of plate metal.

Figure 8:
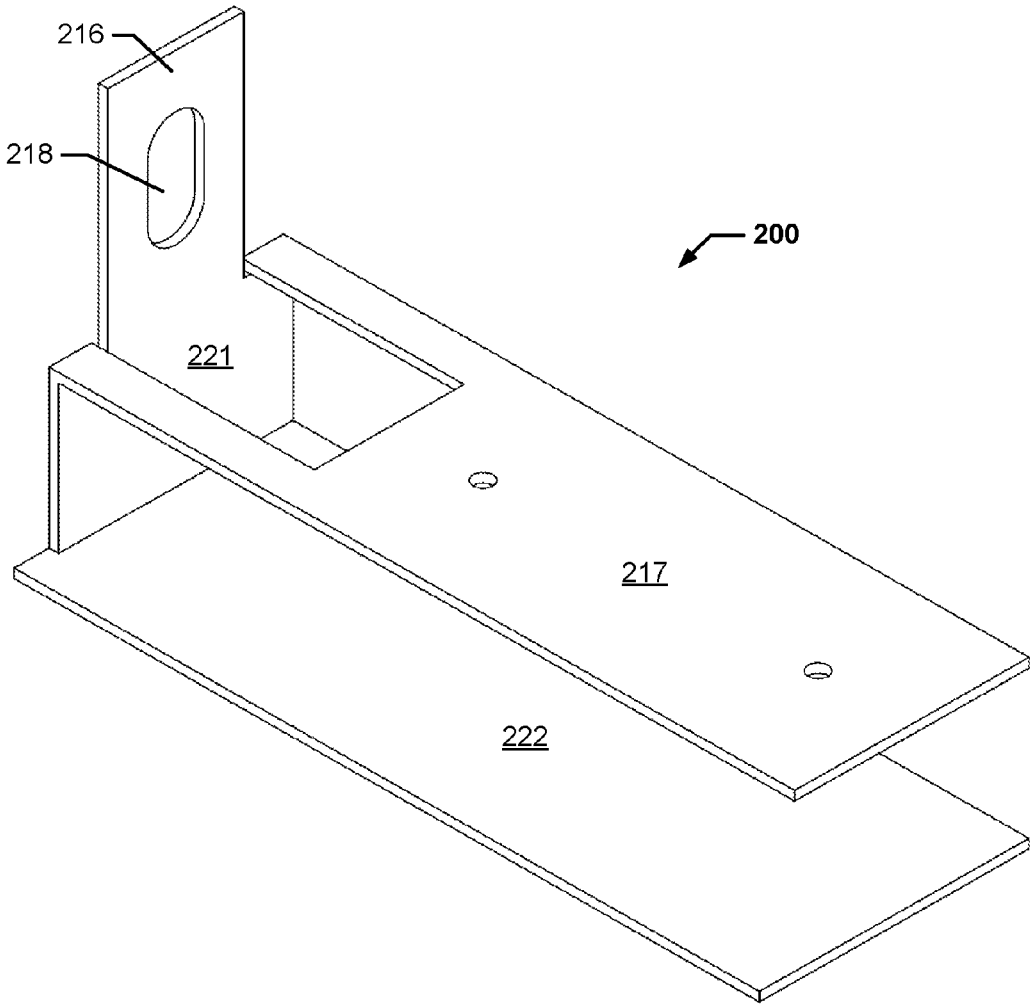
FIG. 8 shows a perspective view of a holding bracket according to the bracket set of the second aspect of the invention.

FIG. 8 shows the holding bracket 200 shaped like the corner bracket 100 of FIGS. 5*a*, 5*b* and 5*c*, but with the difference that it comprises only one single associated abutment plate 217 and flange 222, one associated holding plate 221 and one associated base arm 216. The holding bracket 200 may be manufactured by cutting along the attaching edges 123*a*, 123*b* of the corner bracket 100 to separate the two flanges 122*a*, 122*b*. The holding bracket is thus adapted to hold a board 1*a*, 1*b*, 1*c*, 1*d* to the exterior face of the façade 8 anywhere along the boards.

Figure 9:
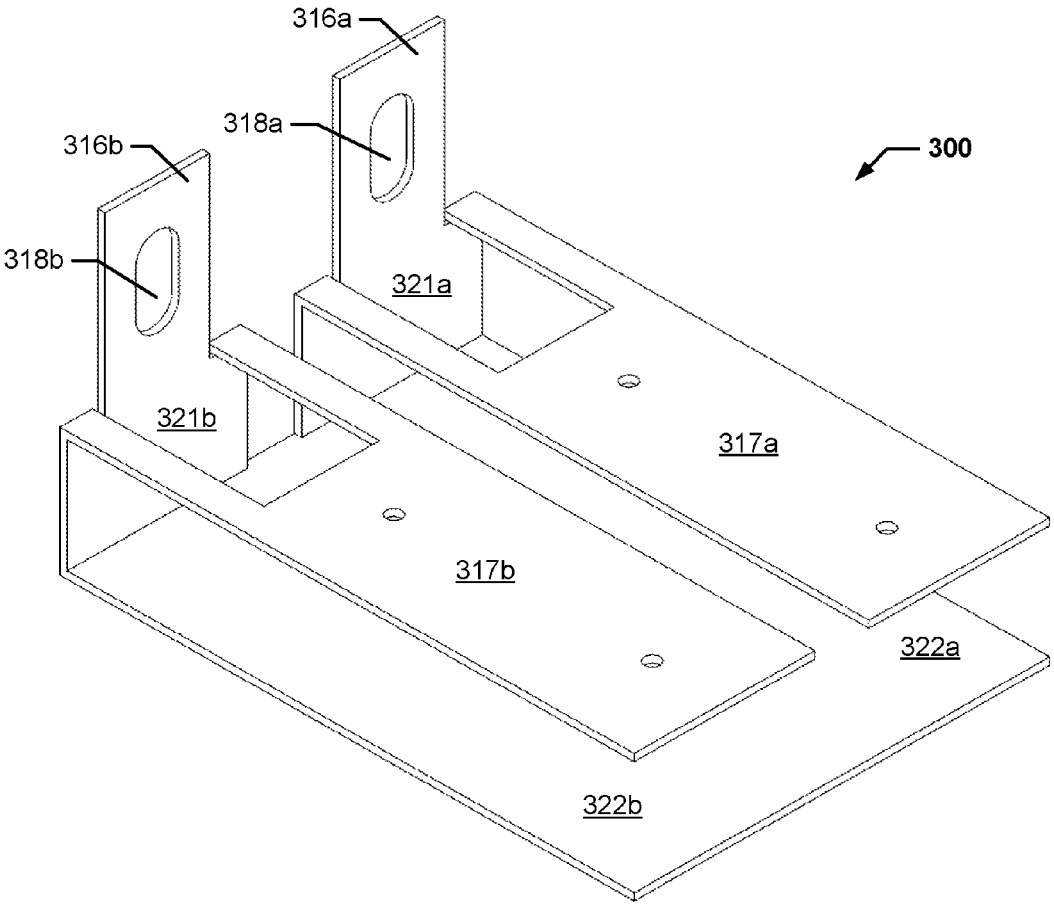
FIG. 9 shows a perspective view of a joining bracket according to the bracket set of the second aspect of the invention.

FIG. 9 shows a joining bracket 300 shaped like the corner bracket 100, but with the difference that an angle between planes in which the flanges 322*a*, 322*b* extend is approximately 180°. Hereby, the abutment plates 317*a*, 317*b* and flanges 322*a*, 322*b* extend in a mutual plane, so that the joining bracket 300 may be used to join two board pieces of one collar board 1*a*, 1*b*, 1*c*, 1*d* extending in a mutual longitudinal direction. Each board 1*a*, 1*b*, 1*c*, 1*d* may thus be received between a respective flange 322*a*, 322*b* and its associated abutment plate 317*a*, 317*b* of said joining bracket 300, see further below. The joining bracket 300 can be manufactured by avoiding the folding along the attaching edges 123*a*, 123*b* of the corner bracket 100 as shown in FIG. 6*a*. The joining bracket 300 can also be used as a holding bracket, i.e. without joining two board pieces.

The window frame is mounted in the mounting collar and can be fixed in place by conventional means. For example, screws could be inserted through the window frame and into the mounting collar. If the material of mounting collar allows the screws to be pulled out too easily, it may be necessary to arrange a plate at the outside face of the mounting collar. A screw can then be inserted through the window frame, through the mounting collar and through the plate to provide a firmer connection. However, if external wall insulation is already in place, then positioning of a plate at the outside face of the mounting collar can be difficult.

Therefore, it has been found to be particularly advantageous to use a frame mounting clip to mount the window frame in the mounting collar. The frame mounting clip has a base plate and first and second side plates extending from opposite ends of the base plate, substantially perpendicular to the base plate and substantially parallel to each other. The clip can be arranged on the mounting collar at its second end such that the first side plate abuts an inside face of the mounting collar and the second side plate abuts an outside face of the mounting collar. In order to mount the window frame in place, a screw is inserted through the window frame, the first side plate of the mounting clip, through the window mounting collar and through the second side plate of the mounting clip.

This clip allows for a stronger attachment of the window frame to the mounting collar and allows for easy positioning of the clip because the base plate of the mounting clip is always easily accessible, even when external wall insulation is in place surrounding the mounting collar.

Figure 10:
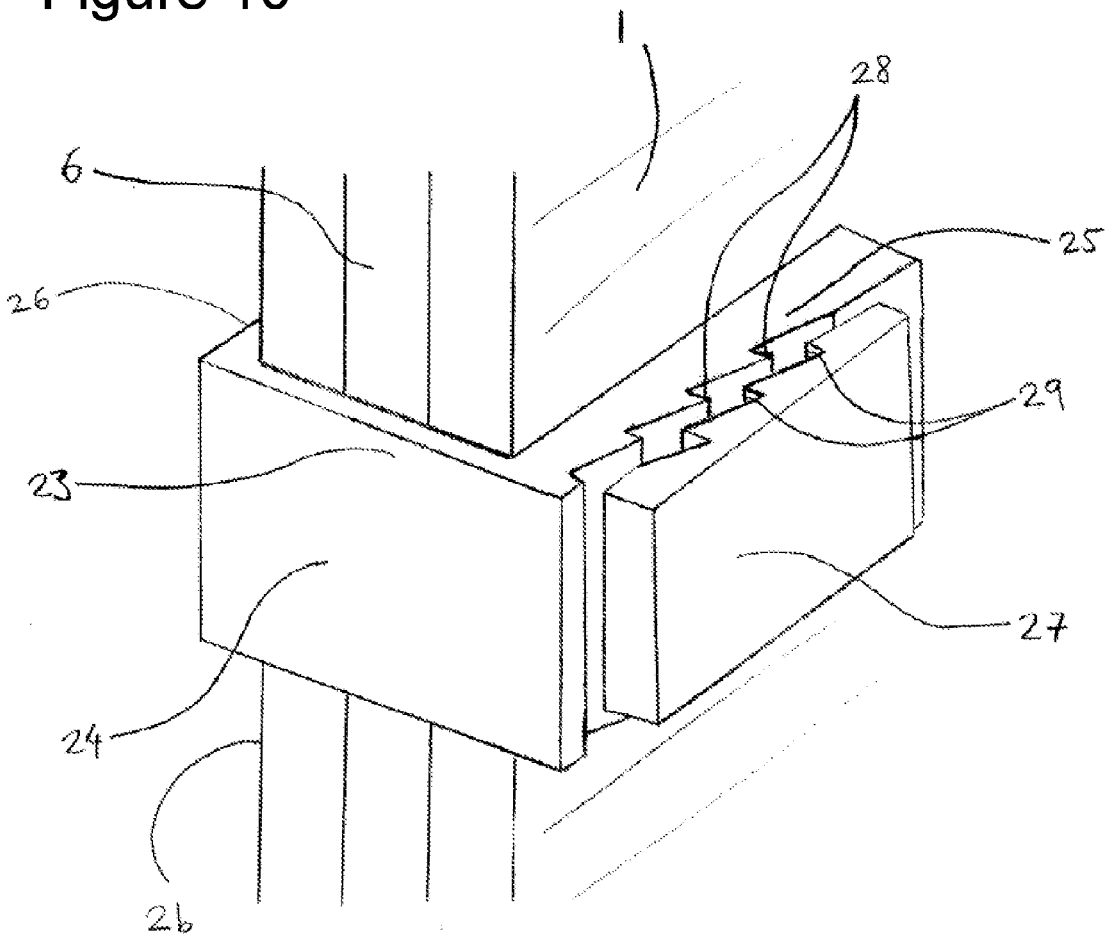
FIG. 10 shows a means by which a window frame can be arranged in a window mounting collar.

The clip can be made of any suitable material with sufficient rigidity and strength and that can accept screws. The clip could, for example, be made of metal. However, materials with a lower thermal conductivity are preferred. In one embodiment, the first and second side plates of the clip each comprise a pre-bored hole to accept a screw. FIG. 10 shows an example of a mounting clip system. The mounting clip 23 has a base plate 24 and first and second side plates 25, 26 extending from opposite ends of the base plate 24. The clip 23 is shown arranged on the mounting collar 1 at its second end 6 such that the first side plate 25 abuts an inside face 2*a* of the mounting collar 1 and the second side plate 26 abuts an outside face 2*b* of the mounting collar 1. The first side plate 25 of the window mounting clip 23 is shaped as a wedge, having a thickness at its end furthest from the base plate 24 that is greater than the thickness of the first side plate 25 of the window mounting clip 23 at its end that is adjoined to the base plate 24.

When assembling the collar 1 of FIG. 5, first the boards 1*a*, 1*b*, 1*c*, 1*d* are cut (e.g. sawed) out from longer board members. If this results in surplus board pieces, examples of surplus board pieces shown as board pieces 1*e* and 1*f* in FIG. 5, of too short lengths, these may be further cut to appropriate sizes to be joined by means of one or more joining brackets 300 to form a resultant board, in the example of FIG. 5 board 1*b*, of suitable length. The boards may alternatively be manufactured from the factory in suitable lengths so as to avoid the sawing operation.

Two respective of the boards 1*a*, 1*b*, 1*c*, 1*d* of the collar 1 are subsequently positioned between abutment plate 117*a*, 177*b* and associated flange 122*a*, 122*b*, respectively, of a first corner bracket 100 to be preliminary retained to the corner bracket 100 between the abutment plates 117*a*, 177*b* and the associated flanges 122*a*, 122*b*. The associated board 1*a*, 1*b*, 1*c*, 1*d* is then permanently retained by means of oblong retention members in the form of bolts (not shown) inserted through the retention apertures 130*a*, 130*b* of the abutment plates 117*a*, 117*b*, through the associated board 1*a*, 1*b*, 1*c*, 1*d*, and through further, associated retention apertures (not shown) of flanges 122*a*, 122*b*. Hereby, the two associated boards 1*a*, 1*b*, 1*c*, 1*d* are positioned in the bracket 100 as shown in FIG. 5, the boards 1*a*, 1*b*, 1*c*, 1*d* forming a collar corner of the collar 1. This procedure is subsequently performed with each corner bracket of the collar 1, thereby resulting in a finished collar 1 as shown in FIG. 5. The boards may alternatively be inserted preliminarily in all the collar corners before permanent retention is achieved by means of the bolts. One or more holding brackets 200 are before or after attachment of the corner brackets 100 attached to the boards 1*a*, 1*b*, 1*c*, 1*d* to further attach the boards 1*a*, 1*b*, 1*c*, 1*d* to the façade 8. Screws or bolts are inserted through receiving apertures 18, 118*a*, 118*b*, 218, 318*a*, 318*b* into the façade 8 to affix the collar 1 to the façade 8; this may be done before, during or after assembly of the collar 1.

In the embodiment shown the mounting clip 23 forms one part of a clip system. The clip system comprises the mounting clip 23 and a separate plate 27. The face of the first side plate 25 of the mounting clip that faces away from the second side plate has ridges 28. The peaks of the ridges are substantially parallel to the base plate 24 of the clip. The clip system also comprises a separate plate 27 having ridges 29 on one of its faces that are adapted to cooperate with the ridges 28 on the first side plate 25 of the mounting clip. A window frame not shown can be set in place by positioning the window frame in the mounting collar 1 and then pushing the separate plates 27 in between the window frame and the mounting clip 23. The frame is then fixed in place with screws.

What is claimed is:

1. A corner bracket for assembly of two boards of a window mounting collar into a collar corner and for affixing said window mounting collar to an exterior face of a building façade so as to surround a window opening, said corner bracket comprising;

two holding plates and two base arms adapted for extending in planes parallel with and having back surfaces abutting the exterior face of the building façade in an affixed position of the collar, the two base arms each being adapted for receiving a fixation member for insertion therethrough and into the building façade such as to fixate the collar to the façade;

a flange arm comprising two flanges adapted to extend away from said exterior face in the affixed position of the collar, each flange having a proximal end configured to be proximal and a distal end configured to be distal to the exterior face in the affixed position of the collar, each flange further having an attaching edge extending from the proximal end to the distal end, the attaching edges of the flanges being attached to each other along at least a part of the attaching edges, the flanges extending with an angle between them such as to form a flange corner at said attaching edges, the flange corner being adapted to be positioned in an inner corner formed between the two boards in the affixed position of the collar;

two abutment plates adapted to extend away from said exterior face in the affixed position of the collar, each abutment plate having a proximal end configured to be proximal and a distal end configured to be distal to the exterior face in the affixed position of the collar, each abutment plate being adapted to abut a respective outer surface of the two boards in the affixed position of the collar; and each abutment plate being positioned at a mutual distance from and in parallel with an associated said flange, each abutment plate being connected to the associated said flange via an associated said holding plate;

so as to be able to hold said boards together to form said window collar corner, each board being received between a respective flange and its associated abutment plate.

2. The corner bracket according to claim 1, wherein said two abutment plates are positioned at a distance from each other.

3. The corner bracket according to claim 2, wherein each abutment plate does not extend beyond a plane in which its non-associated flange extends.

4. A window mounting collar comprising at least one inside face, at least one outside face, a first open end and a second open end and the corner bracket according to claim 2.

5. A window mounting collar according to claim 4, wherein at least one of the boards comprises or is manufactured from man-made vitreous fibre material.

6. A window mounting system comprising a building façade having an interior face and an exterior face and comprising a window opening; and a window mounting collar according to claim 4, wherein the window mounting collar is affixed to the exterior face of the building façade by the at least one of the base arms of the corner system so as to surround the window opening and extend outwards from the exterior face of the façade, such that the first end of the mounting collar is proximal to the building façade and the second end of the mounting collar is distal from the building façade.

7. The window mounting system according to claim 6, further comprising external wall insulation affixed to the exterior face of the building façade so as to surround the window mounting collar.

8. The window mounting collar according to claim 4 comprising two side boards, an upper cross board and a lower cross board, each having an inside face and an outside face, wherein at least one of the two side boards is joined orthogonally to the upper and lower cross boards by means of the corner bracket.

9. The corner bracket according to claim 1, wherein the corner bracket is obtainable by a process of punching one single work-piece out from a single sheet of plate metal and folding or bending the work-piece into shape.

10. The corner bracket according to claim 1, wherein said two flanges extend in respective planes forming a mutual angle of 60-120°, and/or said two abutment plates extend in respective planes forming a mutual angle of 60-120°, and/or each associated abutment plate and flange extend in parallel planes.

11. The corner bracket according to claim 10, wherein said two flanges extend in respective planes forming a mutual angle of 80-100°, and/or said two abutment plates extend in respective planes forming a mutual angle of 80-100°.

12. The corner bracket according to claim 1, wherein each associated holding plate and flange extend in respective planes forming a mutual angle between approximately 60-120°, and/or each associated holding plate and abutment plate extend in respective planes forming a mutual angle between approximately 60-120°.

13. The corner bracket according to claim 1, wherein each of said base arms are formed as an extension of the associated said holding plate, each base arm extending away from a plane of the associated said abutment plate so that the associated fixation member can be inserted through the base arm when the two boards are positioned to be held between the respective flanges and abutment plates, and/or at least one of said base arms comprises a receiving aperture for receiving the fixation member therethrough.

14. The corner bracket according to claim 1, wherein each of said base arms is obtainable by punching it out from an associated one of said abutment plates and folding it into position.

15. The corner bracket according to claim 1, wherein at least one of each associated abutment plate and flange comprises at least one retention aperture positioned for receiving a retention member, such as a screw or a bolt, inserted through the associated abutment plate, through the board to be positioned between the associated abutment plate and flange, and through the associated flange so as to press the board in between the associated abutment plate and flange to retain the board, the abutment plate and flange being pulled against each other by means of the retention member.

16. A corner system comprising the bracket according to claim 1, further comprising two boards of a window mounting collar assembled to form a collar corner by means of the corner bracket, said two boards being held together by the corner bracket to form said collar corner, each board being received between a respective flange and its associated abutment plate, wherein each board has an outer board surface, which is adapted to be parallel with and to face away from the exterior face of the façade in the affixed position of the collar, each flange and associated abutment plate being in contact with an associated one of said two boards, the distal end of each flange and/or of each abutment plate being positioned at a distance from the outer board surface of its associated board, said distal end of said flange or abutment plate being positioned at a distance from the outer board surface of its associated board of 10% to 150% of a length of the respective flange or abutment plate.

17. A bracket set comprising the corner bracket according to claim 1, further comprising a holding bracket shaped like the corner bracket, but with the difference that it comprises only one single associated abutment plate and flange, one associated holding plate and one associated base arm so that the holding bracket can be manufactured by cutting along the attaching edges of the corner bracket to separate the two flanges, the holding bracket thus being adapted to hold a collar board to the façade, and/or a joining bracket shaped like the corner bracket, but with the difference that an angle between planes in which said flanges extend is approximately 180°, said abutment plates further extending in a mutual plane, so that the joining bracket can be used to join two collar boards extending in a mutual longitudinal direction, each collar board being received between a respective flange and its associated abutment plate of said joining bracket.

18. A window mounting collar corner comprising the corner bracket according to claim 1 for holding together two boards of a window mounting collar, each board being received between a respective flange and its associated abutment plate and attached by means of a retention member inserted through the respective flange, the respective board and the abutment plate associated with said respective flange, and further for affixing said window mounting collar to an exterior face of a building façade so as to surround a window opening, the two base arms each receiving a fixation member for insertion therethrough and into the building façade such as to fixate the window mounting collar to the façade.

* * * * *